US010040209B2

(12) United States Patent
Atkins

(10) Patent No.: US 10,040,209 B2
(45) Date of Patent: Aug. 7, 2018

(54) HAIR CLIPPER AND METHOD OF FORMING THE SAME

(71) Applicant: Adreis Atkins, Decatur, GA (US)

(72) Inventor: Adreis Atkins, Decatur, GA (US)

(73) Assignee: Adreis Atkins, San Tan Valley, AZ (US)

( * ) Notice: Subject to any disclaimer, the term of this patent is extended or adjusted under 35 U.S.C. 154(b) by 80 days.

(21) Appl. No.: 15/172,155

(22) Filed: Jun. 3, 2016

(65) Prior Publication Data

US 2016/0354938 A1 Dec. 8, 2016

Related U.S. Application Data

(60) Provisional application No. 62/170,271, filed on Jun. 3, 2015.

(51) Int. Cl.
*B26B 19/38* (2006.01)
*B26B 19/28* (2006.01)

(52) U.S. Cl.
CPC ..... *B26B 19/3853* (2013.01); *B26B 19/28* (2013.01); *B26B 19/3886* (2013.01); *B26B 19/3893* (2013.01)

(58) Field of Classification Search
CPC . B26B 19/3853; B26B 19/28; B26B 19/3886; B26B 19/3893
See application file for complete search history.

(56) References Cited

U.S. PATENT DOCUMENTS 3,710,224 A * 1/1973 Daniels ..... B26B 19/286 320/115
5,075,971 A * 12/1991 McCambridge ..... B26B 19/06 30/133
6,314,648 B1 * 11/2001 Hillebrandt ..... B26B 19/10 30/208
2006/0162516 A1 * 7/2006 Andis ..... B26B 19/06 83/13
2015/0293567 A1 * 10/2015 Broadwell ..... G06F 1/203 361/679.48

* cited by examiner

*Primary Examiner* — Daniel J Colilla

(57) ABSTRACT

Disclosed is a hair clipper for cutting and trimming the hair of humans or animals. The hair clipper includes a hair clipper case, blade assembly and a motor drivingly coupled to the blade. The hair clipper includes a first and second fan that blows air over the motor to cool the motor so that the hair clipper does not get hot to the touch. The hair clipper also includes an ergonomically designed case that helps the barber or hair stylist hold, grip and easily maneuver the hair clipper. The hair clipper also includes a power cord with a power converter in the plug end of the power cord. Power cord collects 120 Volts AC power from a wall socket, and conducts both 120 volt AC power and 5 volt DC power to the hair clipper. Both 120 volt AC power to motor and 5 volt DC power to cooling fans have separate off and on switches that regulates power, which allows the fans to run separate from motor.

6 Claims, 12 Drawing Sheets

HAIR CLIPPER AND METHOD OF FORMING THE SAME

BACKGROUND OF THE INVENTION

Technical Field

This invention relates to hair clippers and in particular to a hair clipper with an ergonomically designed case that contains two cooling fans and a power cord that delivers 5 volt power to the cooling fans.

State of the Art

Electric hair clippers, also called hair trimmers, have been in common use by barbers and hair stylists for over a century. A hair clipper includes a blade assembly that is drivingly coupled to a motor. The motor moves the blades of the blade assembly such that the blades cut hair. The hair clipper is used to trim and cut either human or animal hair. Improvements in hair clipper heat dissipation capability, power consumption, user comfort and safety are continually needed to improve the user and client experience.

DETAILED DESCRIPTION OF EMBODIMENTS OF THE INVENTION

Figure 1:
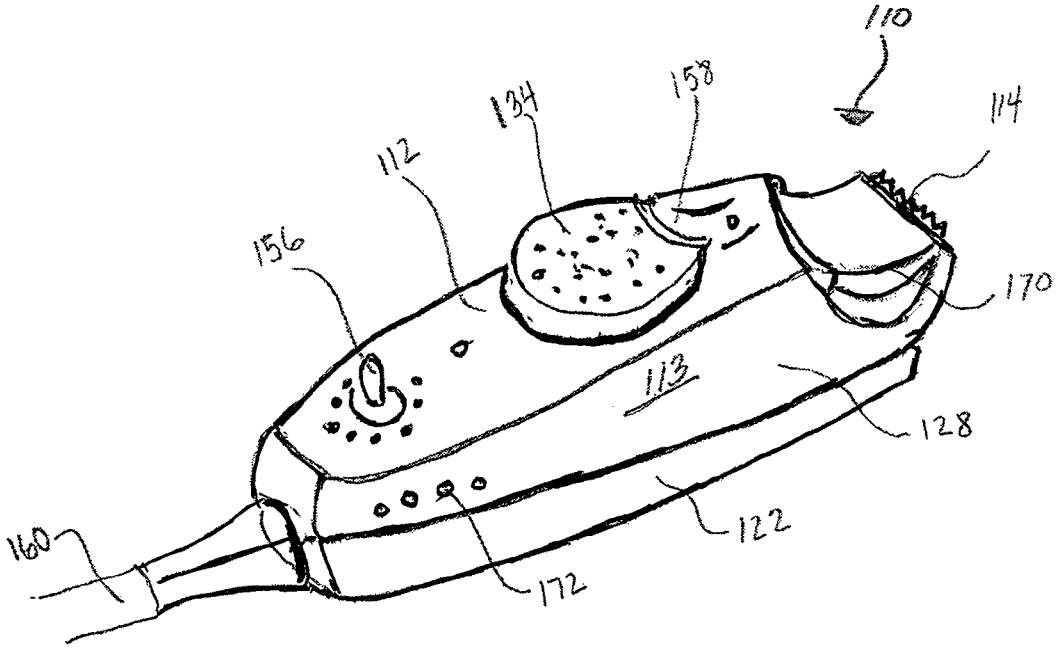
FIG. 1 shows a top perspective view of a hair clipper.

Embodiments of the present invention relate to hair clippers and in particular to a hair clipper with an ergonomically designed case that contains two cooling fans and a power cord that provides 5 volt power for the cooling fans, as well as 120 volt power to the motor. The hair clipper includes two cooling fans that are enclosed in the clipper case with a clipper motor. A first cooling fan is enclosed in a hollow cylindrical projection formed as part of the clipper case. The first cooling fan is enclosed in the hollow cylindrical projection above the clipper motor, and draws air into the case and towards the motor. A second cooling fan is enclosed in the clipper case towards a cord end of the case, and draws air away from the motor. Both cooling fans draw 5 volts of direct current (DC) power, whereas the motor uses 120 volt alternating current (AC) power. The disclosed clipper has a power cord with a power converter contained in a plug of the power cord. The power converter converts 120 volts AC power received from the wall receptacle into 5 volts DC power. The power cord then conducts both 120 volts AC power and 5 volts DC power from the plug to the hair clipper case. The power cord supplies the 120 volt AC power to the motor, and the 5 volts DC power to the first and the second fan. The clipper case is ergonomically designed with a thumb indent in the top portion of the case, three finger indents in the bottom portion of the case, and a blade guard surrounding much of the blade. The disclosed clipper stays cool during use, is easier to control to obtain more precise hair trimming, and protects the client from the blade.

Electric hair trimmers, or clippers, have been in common use by barbers and hair stylists for over a century. A hair clipper includes a blade assembly that is drivingly coupled to a motor. The motor moves the blades of the blade assembly in such a way that the blades cut hair. The motor and the blade assembly are contained in a clipper case that obtains 120 volt AC power from an electric cord that plugs into a wall outlet.

There are several issues with common types of hair clippers. First of all, the hair clipper motor emits heat during use, and the hair clipper case becomes hot. In order to keep from getting burned by the hot clipper case, barbers typically buy two or more hair clippers and alternate their use. While a first hair clipper is cooling down, the barber uses a second hair clipper. When the second hair clipper becomes hot, they set it down and go back to using the first hair clipper, which has hopefully cooled down. It is desirable to have a hair clipper that does not heat up during use and, therefore, require the purchase of more than one hair clipper.

In addition, clipper cases can be unwieldy to handle. Hair clipper cases are typically smooth plastic or metal with few, if any surface features or textures. A good barber needs to move the clippers with precision to trim hair and create the desired hair layering and trimming. It is desirable to have a clipper case with strategically placed features so the case can be held securely and maneuvered easily and flowingly with the fingers while trimming. It is also desirable for the clipper case to have features that protect the client's ears and skin from being nicked by the trimmer blade during precision and close trimming.

Figure 2:
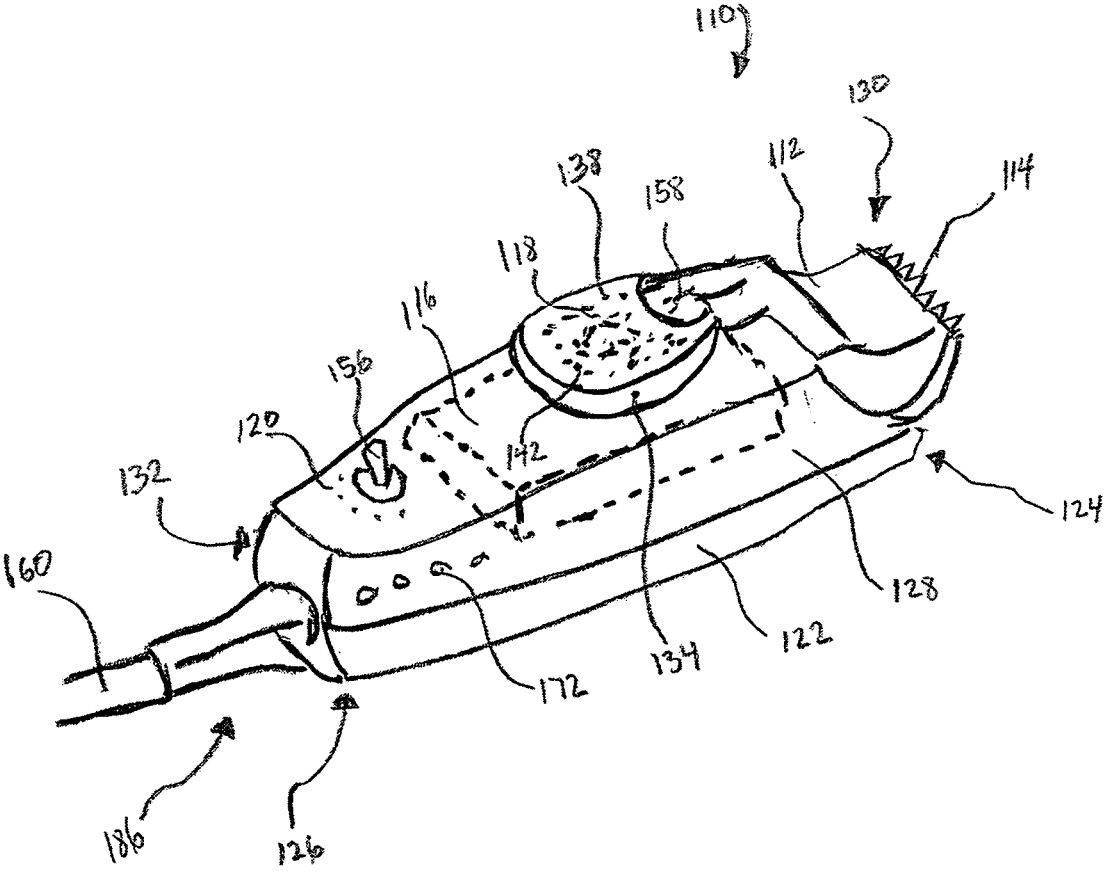
FIG. 2 shows a top perspective view of the hair clipper of FIG. 1.
Figure 3:
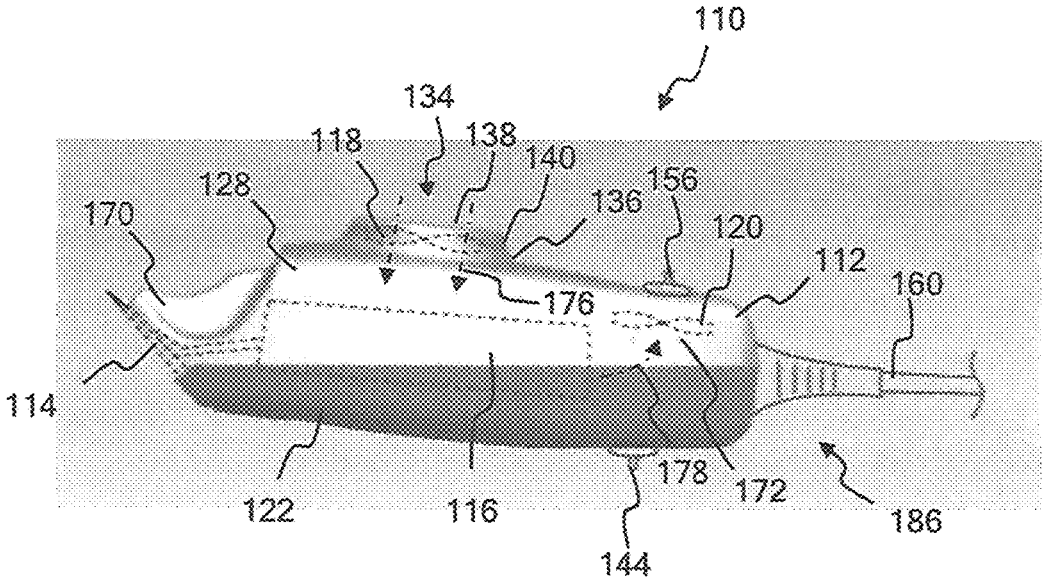
FIG. 3 shows a side view of the hair clipper of FIG. 1.

FIG. 1 shows a perspective view of a hair clipper 110. Hair clipper 110 includes a clipper case 112 and a blade assembly 114. Blade assembly 114 is coupled to case 112 and is configured to cut hair. A power cord 160 provides power to clipper 110, FIG. 2 shows the perspective view of clipper 110 of FIG. 1, showing some of the internal components in dotted lines. FIG. 3 shows a side view of clipper 110 of FIG. 1, also showing the internal components in dotted lines. As can be seen in FIG. 2 and FIG. 3, clipper 110 includes a motor 116 enclosed in case 112 and drivingly coupled to blade assembly 114. Clipper 110 also includes a first fan 118 enclosed in clipper case 112, and a second fan 120 enclosed in clipper case 112. First fan 118 sits above motor 11$ and directs air 176 (see FIG. 3) towards motor 116. Second fan 118 sits between motor 116 and a clipper case cord end 186 and blows air 178 away from motor 116. Hair clipper 110 includes two fans in the embodiment shown in the figures, but this is not meant to be limiting. In some embodiments hair clipper 110 includes one fan. In some embodiments clipper 110 include more than two fans enclosed in clipper case 112.

Clipper case 112 includes a bottom portion 122 and a top portion 128. Bottom portion 122 and top portion 128 removeably couple together in this embodiment to enclose the contents of hair clipper 110. In some embodiments clipper case 112 uses a single-piece case, or a case with more than two portions. Top portion 128 has a top portion blade end 130 and a top portion cord end 132. Bottom portion 122 has a bottom portion blade end 124 and a bottom portion cord end 126 (See FIG. 2).

Clipper case 112 includes a motor power switch 156 coupled to top portion 128. Motor power switch 156 is an electrical switch which turns power on and off to motor 116. Motor power switch 156 is a toggle switch in this embodiment, but this is not meant to be limiting. Motor power switch 156 can be any type of switch configured to turn power on and off to motor 116.

Second fan 120 is positioned beneath motor power switch 156, see FIG. 2 and FIG. 3. Second fan 120 draws air 178 away from motor 116 and directs it out of a set of side vent holes 172 in top portion 128.

Top portion 128 also includes a hollow cylindrical projection 134. Hollow cylindrical projection 134 extends outward from top portion 128 and encloses first fan 118, as shown in FIG. 2 and FIG. 3. Hollow cylindrical projection 134 is included in clipper case 112 to make room in clipper case 112 for first fan 118 without making all of clipper case 112 larger. Hollow cylindrical projection 134 is positioned between top portion blade end 130 and motor power switch 156 in this embodiment. Hollow cylindrical projection 134 has a base 136 (see FIG. 3) which is where cylindrical projection 134 meets the remainder of top portion 128. Hollow cylindrical projection 134 extends outward from top portion 128 at base 136. Base 136 is open to the interior of clipper case 112 so that first fan 118 can move into and out of cylindrical projection 134 from the interior of clipper case 112. Hollow cylindrical projection 134 also includes a cover 138 which encloses hollow cylindrical projection 134. Cover 138 has a plurality of vent holes 142 (see FIG. 2) which allow air to pass through into clipper case 112. First fan 118, which is positioned inside of hollow cylindrical projection 134 beneath cover 138, draws air 176 through plurality of vent holes 142 towards motor 116. First fan 118 is positioned between cover 138 and motor 116. Hollow cylindrical projection 134 also includes sides 140 extending between base 136 and cover 138. In this embodiment motor power switch 156 is positioned between hollow cylindrical projection 134 and cord end 132 of top portion 128. Plurality of vent holes 142 includes a number of small vent holes instead of only one or a couple larger vent holes. Using a plurality of small vent holes 142 increases the lifetime of hair clipper 142 because hair is less likely to get sucked into smaller vent holes 142. Thus hair clogs and blockages are avoided with the use of plurality of vent holes 142.

First fan 118 draws outside cool air 176 into clipper case 112 through vent holes 142 and towards motor 116 to cool motor 116. Second fan 120 draws warm air 178 from near motor 116 away from motor 116 and out side vent holes 172. First and second fans 118 and 120 act together to cool motor 116 and direct air into case 112, over motor 116, and out case 112, keeping motor 116 cool enough to use continuously.

Figure 6:
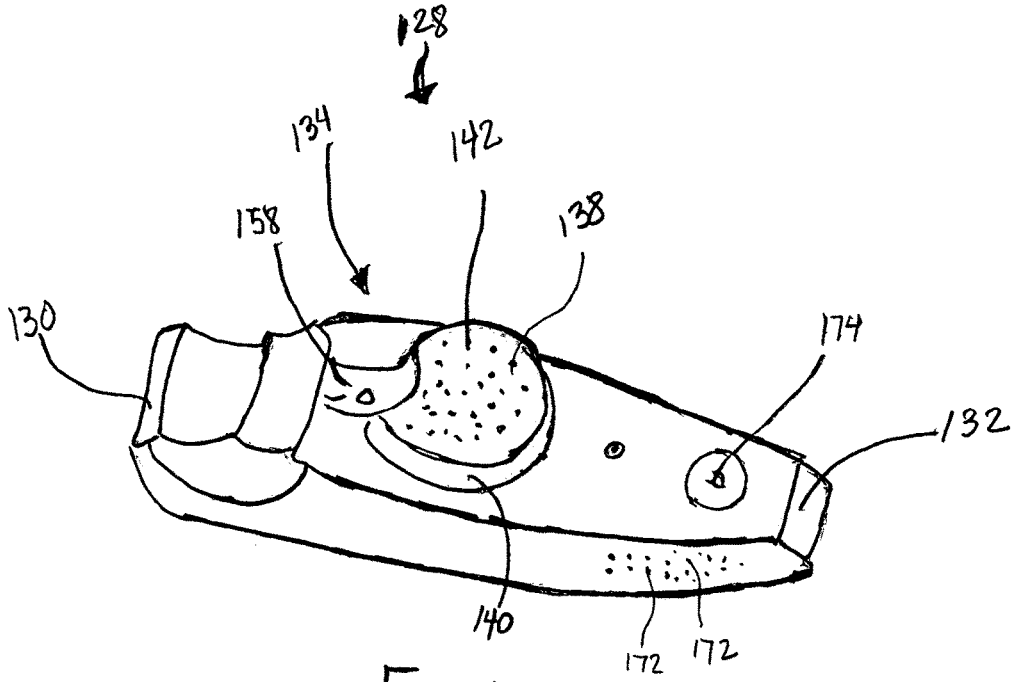
FIG. 6 shows a top perspective view of a top portion of the hair clipper of FIG. 1.

Top portion 128 also includes a thumb indent 158 (See FIG. 6). Thumb indent 158 can be used to cradle a finger or a thumb when using clippers 110. Thumb indent 158 is an indentation in top portion 128 that extends inwardly in top portion 128. Thumb indent 158 gives a finger or thumb a way to hold and put pressure on clippers 110 to move them as needed, without the thumb or finger sliding around on case 112. Thumb indent 158 is positioned between hollow cylindrical projection 134 and blade end 130 of top portion 128. Thumb indent 158 overlays a portion of hollow cylindrical projection 134 such that thumb indent 158 carves out a portion of hollow cylindrical projection 134, giving thumb indent 158 large sides for the thumb or finger using thumb indent 158 to push and hold clipper case 112.

Top portion 128 also includes an ergonomically designed blade guard 170 (see FIG. 1 and FIG. 3). Blade guard 170 covers a portion of blade assembly 114 so that ears, skin, and hair that is not meant to be trimmed does not inadvertently come into contact with blade assembly 114 during trimming. Blade guard 170 is designed for easy cutting movement and clipper 110 maneuvering to get precise hair trimming. Blade guard 170 is ergonomically designed to allow the barber to get better clipper movement around earlobes when trimming behind the ear, and to maneuver around the nose and mouth more easily and exactly when trimming a mustache.

Figure 4:
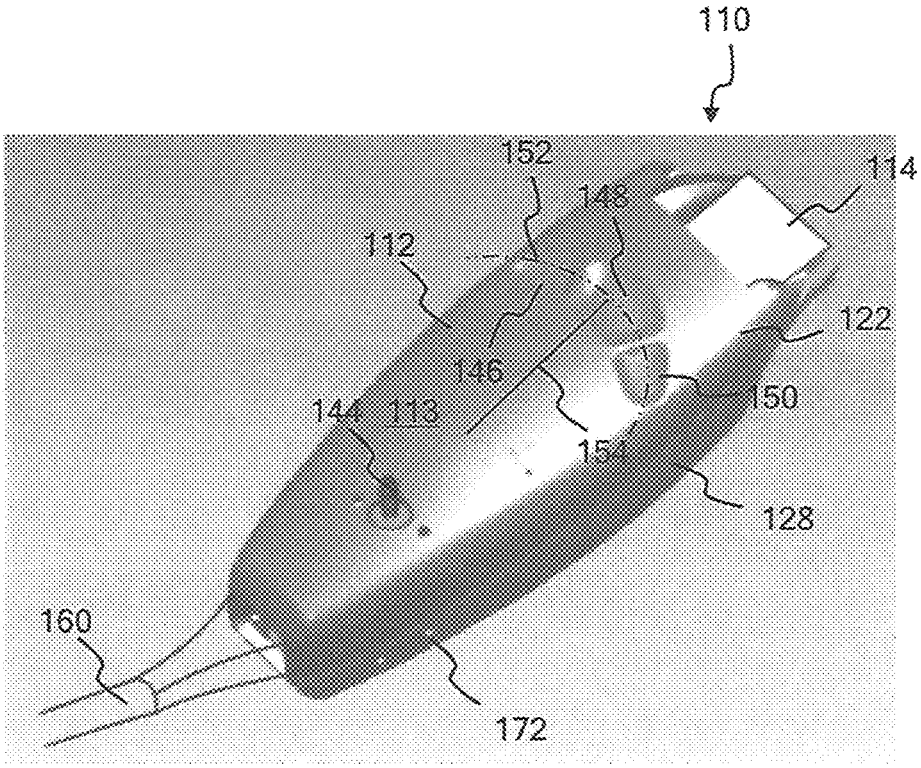
FIG. 4 shows a bottom perspective view of the hair clipper of FIG. 1.
Figure 5:
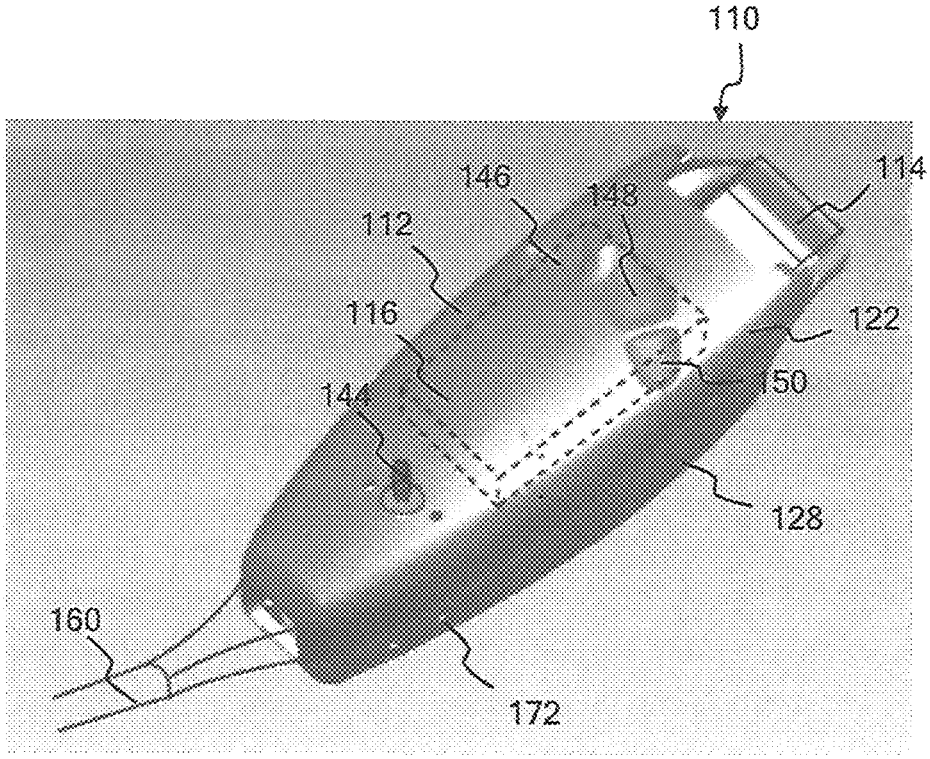
FIG. 5 shows a bottom perspective view of the hair clipper of FIG. 1.

FIG. 4 and FIG. 5 show bottom perspective views of hair clipper 110, FIG. 4 shows a bottom perspective view of hair clipper 110 of FIG. 1. FIG. 5 shows the bottom perspective view of hair clipper 110 of FIG. 4, showing internal components in dotted lines. Clipper case 112 includes a fan power switch 144 coupled to bottom portion 122. an power switch 144 is a toggle switch in this embodiment, but this is not meant to be limiting. Fan power switch 144 is an electrical switch which turns power on and of to both first fan 118 and second fan 120 (see also FIG. 10). Fan power switch 144 is positioned below second fan 120 (see FIG. 3). Second fan 120 is positioned between motor power switch 156 and fan power switch 144. Fan power switch 144 provides the ability to turn fans 118 and 120 on when cooling is needed for motor 116, to leave fans 118 and 120 of when cooling is not needed, and to leave fans 118 and 120 on to cool motor 116 when motor 116 is off.

Fan power switch 144 is used in hair clipper 110 so that motor 116 and fans 118 and 120 do not use the same power switch, and thus do not have to be either on or of at the same time. It is advantageous for the user of hair clipper 110 to be able to use clipper 110 to cut hair, with motor 116 turned on, without turning on fans 118 and 120. For example, a user may want to make a cut or trim with hair clipper 110 that does not take much time and will not cause hair clipper 110 to heat up. In this example is it advantageous for the user of hair clipper 110 to be able to turn on motor 116 with motor power switch 156, without turning on fans 118 and 120, in other words fan power switch 144 is left off. On other instances, it is advantageous for the user to be able to turn on fans 118 and 120, without turning on motor 116. For example, if hair clipper 110 has been in use for a while and is heating up, the user may want fans 118 and 120 to continue to run and cool hair clipper 110, even while motor 116 is turned of and hair clipper 110 is set down. While the barber is attending to other grooming tasks, hair clipper 110 is set down and motor 116 turned off with motor power switch 156. Fans 118 and 120, however, can be used to turn fans 118 and 120 on without motor 116 being turned on, allowing fans 118 and 120 to cool motor 116 while hair clipper 110 is not being used to trim hair. The ability to turn motor 116 and fans 118 and 120 on and off independently of each other great increases the ease of use of hair clipper 110, the ability to use only one hair clipper 110 without it becoming overheated, and the comfort of both the barber and the client. In some embodiments fans 118 and 120 are provided with their own power switches, so that fan 118 and fan 120 can be turned on and off independently of each other, and independently of motor 116. This provides even more flexibility in the use of hair clipper 110.

Bottom portion 122 includes three finger indents 146, 148, and 150 (see FIG. 4 and FIG. 5). Finger indents 146, 148, and 150 are indentations in case 112, protruding inward towards the interior of case 112. Each finger indent 146, 148, and 150 provides a location to position a finger for holding case 112 and provides the finger grip and purchase on case 112 while moving case 112 with the fingers. Finger indents 146, 148, and 150 are positioned between fan power switch 144 and blade end 124 of bottom portion 122. Finger indents 146, 148, and 150 are positioned along a circular segment 152 that has a radius 154 towards fan power switch 144 and cord end 132 of bottom portion 128. Finger indents 146, 148, and 150 are positioned in this way so that whether clipper 110 is being used by the right hand or the left hand, the index and middle finger can easily find and use two finger indents 146, 148 or 150 to hold and grip case 112 so that clipper 110 can be easily maneuvered to trim hair.

Case 112 is finished with a rubber texturized finish on surface 113 of case 112 (see FIG. 1 and FIG. 4), The rubber texturized surface prevents fingers from slipping on the surface, giving the barber or stylist the ability to have a solid grip on clipper 110. The rubber material allows the fingers to press into surface 113 slightly, again providing improved grip on clipper 110 and improved maneuverability for precise hair trimming. The resulting case 112 is easy to hold in the hand, provides indents and grips to allow the fingers and thumb of the right or left hand to securely hold and easily maneuver clipper 112.

Figure 7:
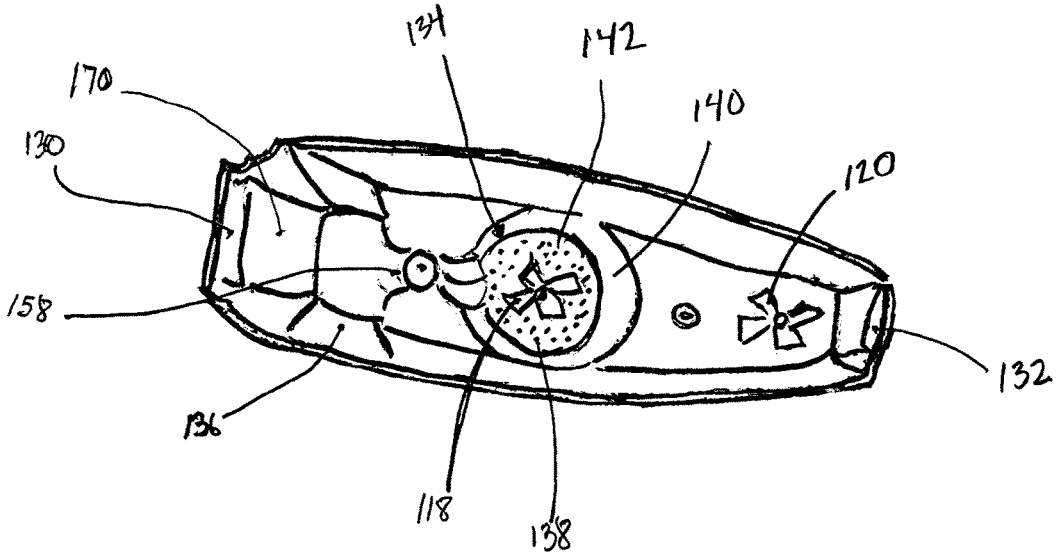
FIG. 7 shows a bottom perspective view of a top portion of the hair clipper of FIG. 1.
Figure 8:
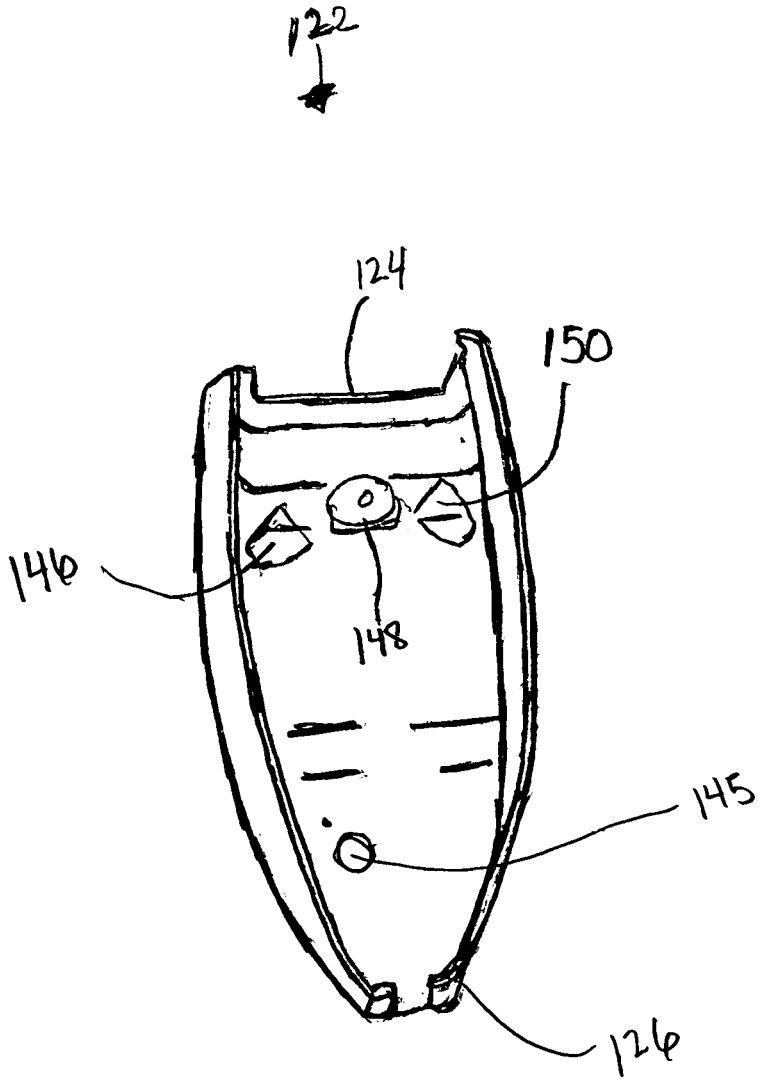
FIG. 8 shows an inside perspective view of a bottom portion of the hair clipper of FIG. 1.

FIG. 6 shows a top perspective view of to portion 128. FIG. 7 shows a bottom perspective view of top portion 128, showing the relative positioning of first fan 118 below cover 138, and second fan 120 below a hole 174 for motor power switch 156. FIG. 8 shows an interior view of bottom portion 122, showing the relative positioning of finger indents 146, 148, and 150 near blade end 124 of bottom portion 122, and hole 145 for fan power switch 144 between finger indents 146, 148, and 150, and cord end 126 of bottom portion 122.

Figure 9:
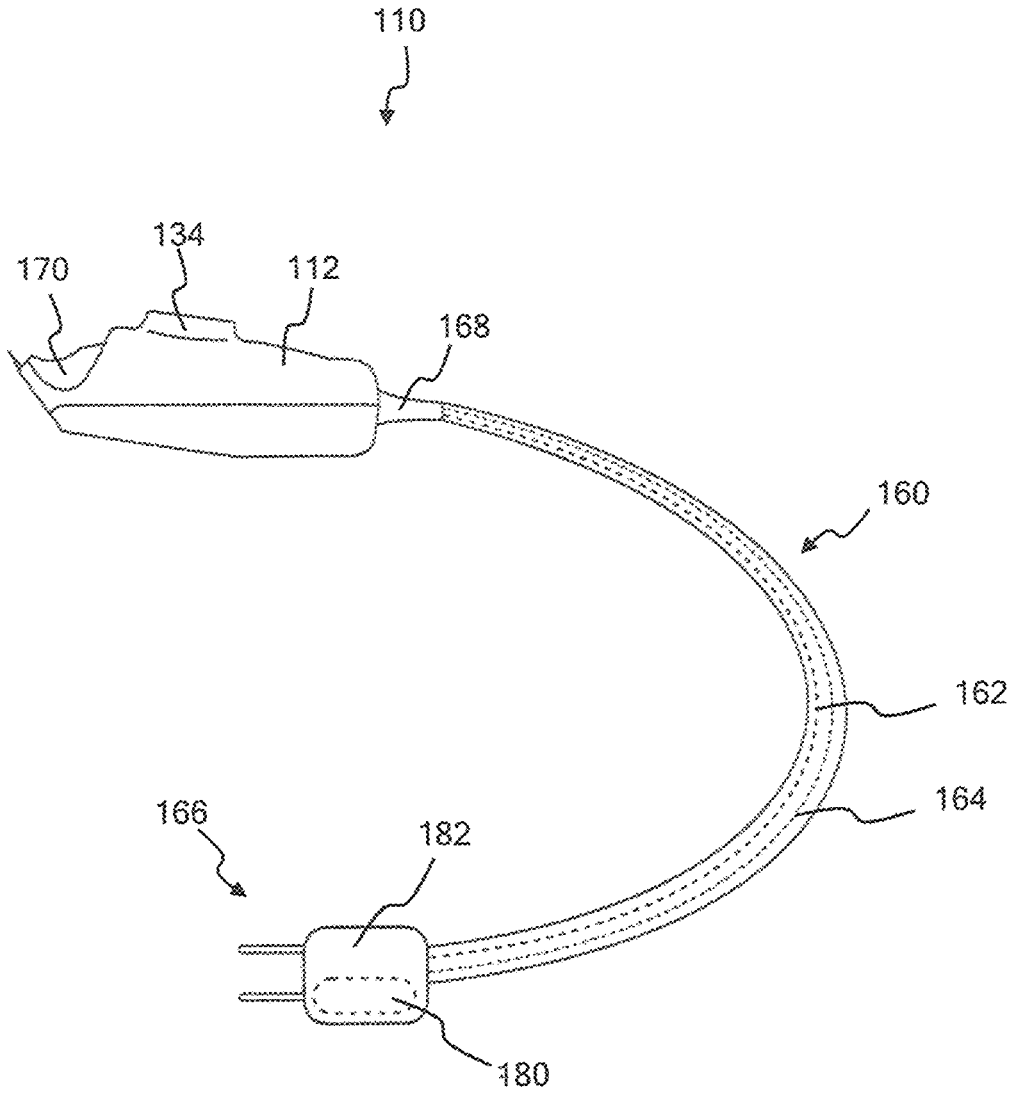
FIG. 9 shows a side view of the hair clipper of FIG. 1.
Figure 10:
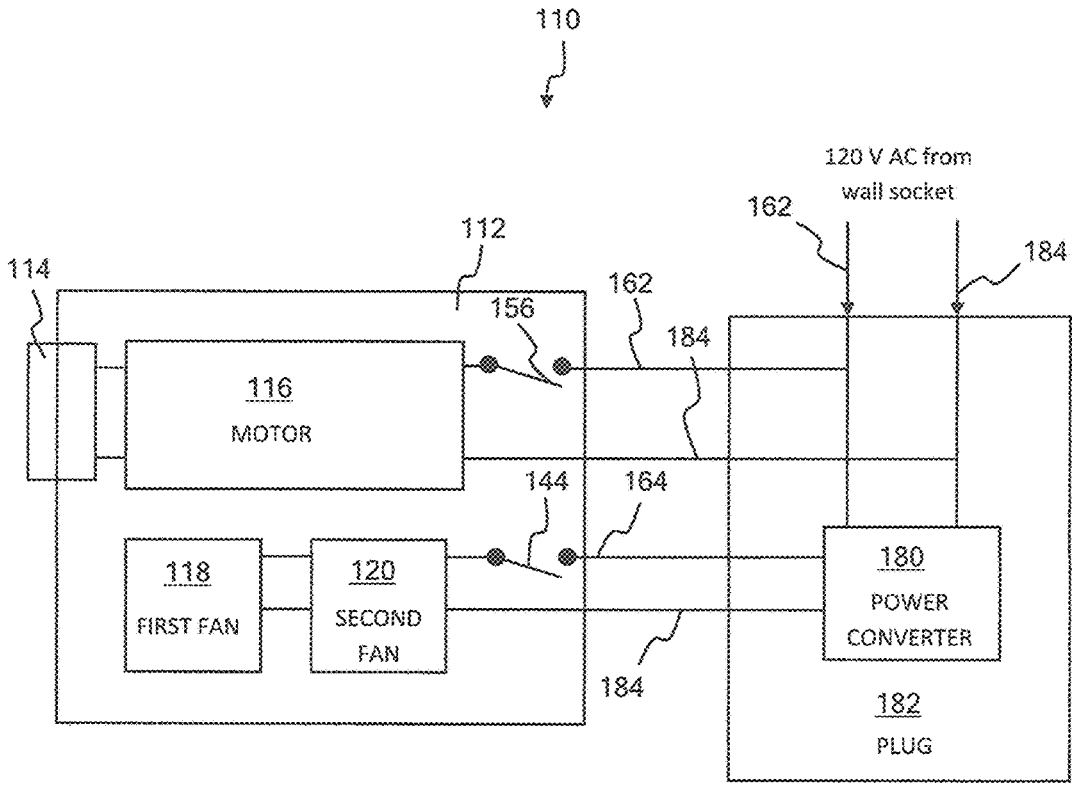
FIG. 10 shows a simplified schematic of the hair clipper of FIG. 1.
Figure 11:
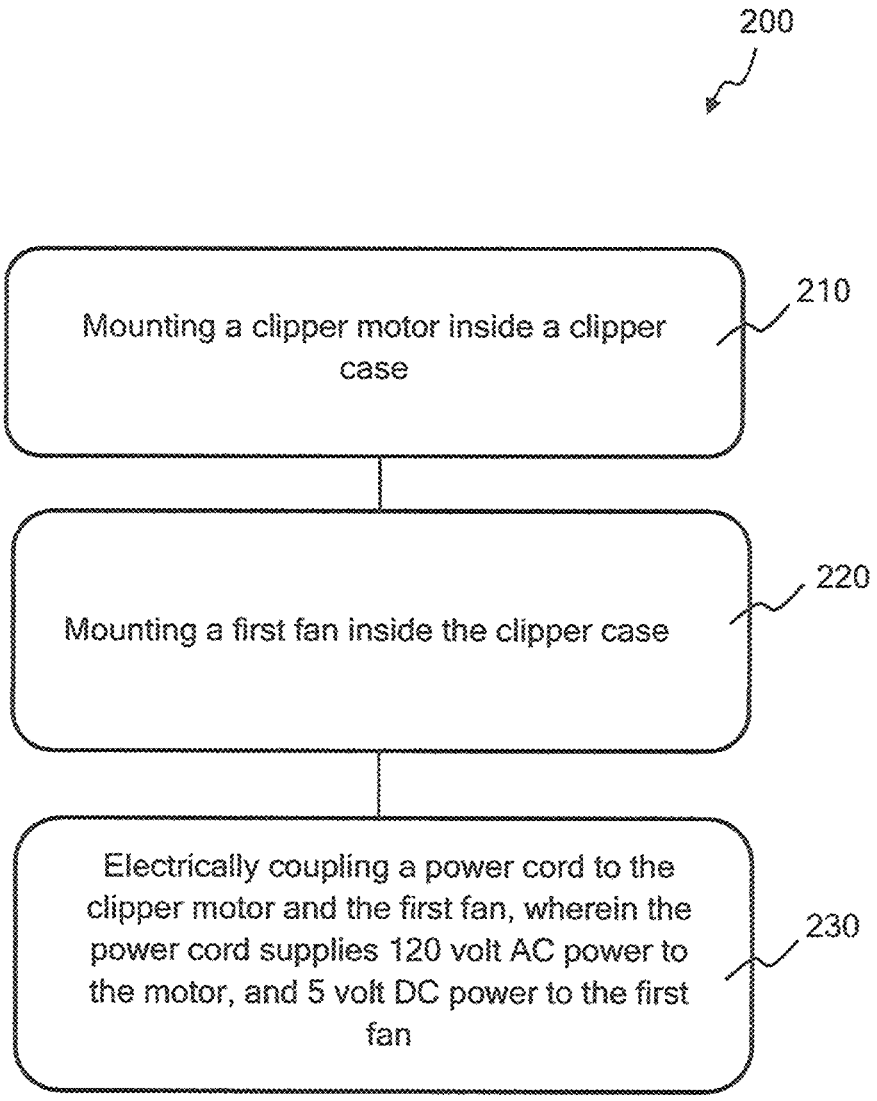
FIG. 11 illustrates a method of forming a hair clipper
Figure 12:
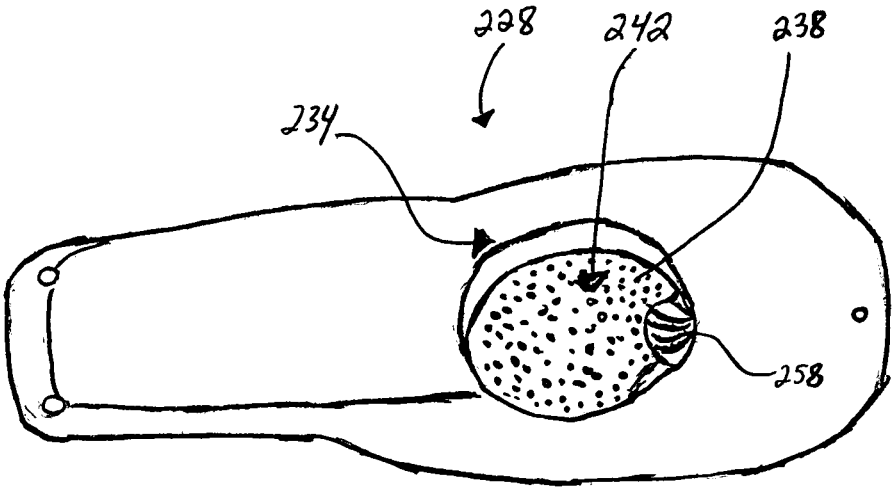
FIG. 12-FIG. 15 show views of a further embodiment of a clipper top case
Figure 13:
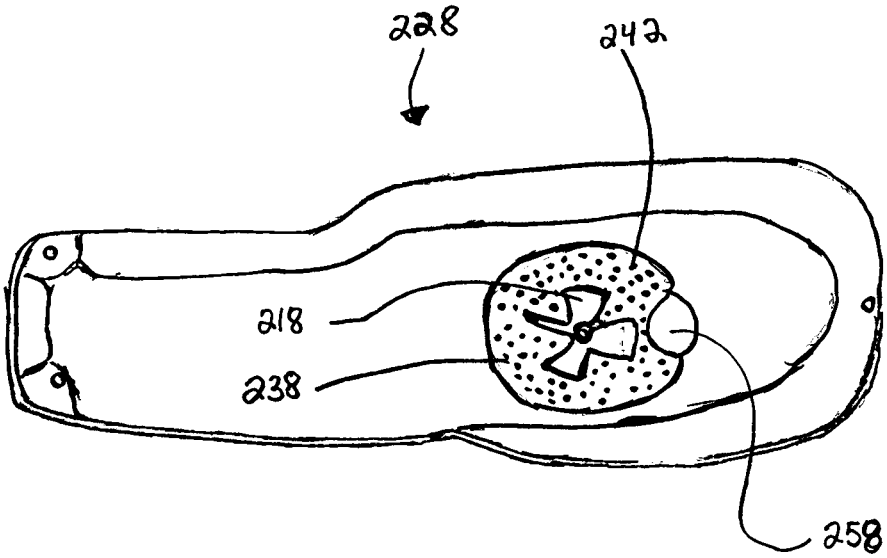
Figure 14:
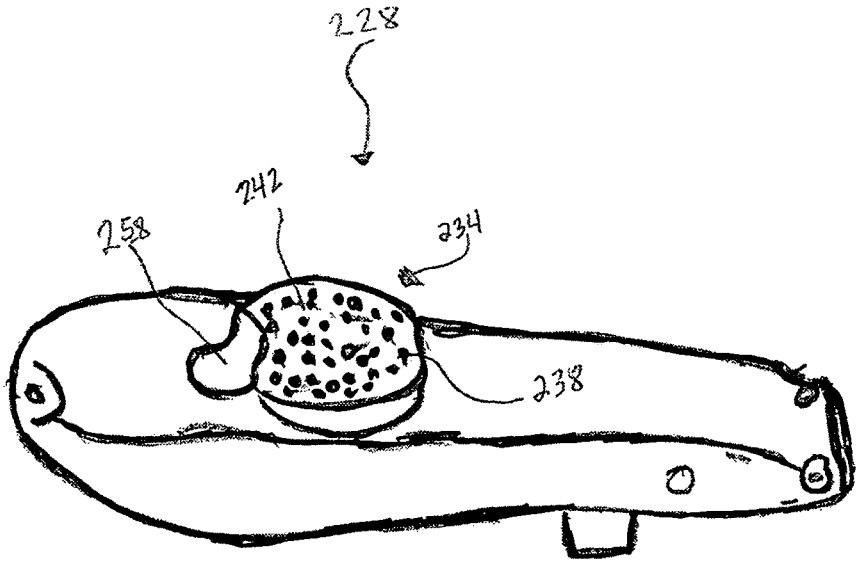
Figure 15:
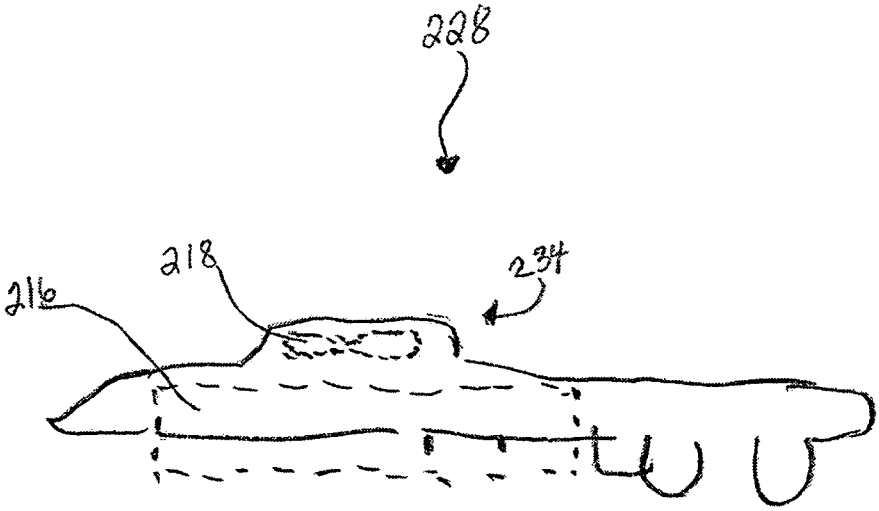
Figure 16:
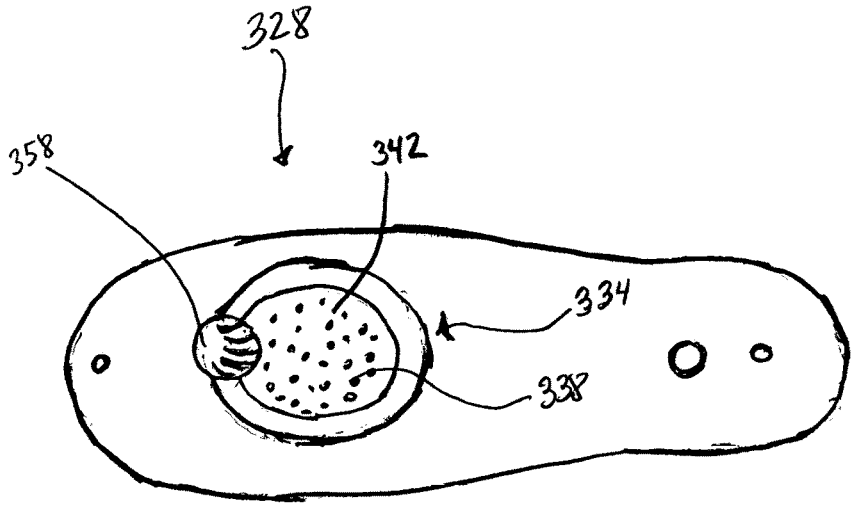
FIG. 16-FIG. 19 show views of an additional embodiment of a clipper top case.

FIG. 9 and FIG. 10 shows details of power cord 160 of hair clipper 110. FIG. 9 shows a side view of clipper 110 including power cord 160, and FIG. 11 shows a simplified schematic diagram of clipper 110 and power cord 160. Power cord 160 includes a plug end 166 and a clipper end 168, with electrical conductors 162 and 164 extending between the two ends. Power cord 160 brings power from a plug 182 to clipper case 112. Plug 182 is adapted to electrically couple with a wall socket and receive 120 volt AC power from the wall socket in this embodiment. It is to be understood that plug 182 and power cord 160 can be adapted to receive other voltages of power according to the location and power protocols available where clipper 110 is to be used. Motor 116 uses 120 volt AC power in this embodiment. Power cord 160 includes 120 volt power conductor 162, which conducts 120 volt AC power from plug end 166 to clipper end 168 of power cord, into case 112 and to motor 116 through motor power switch 156. Power cord 160 also includes ground conductor 184 which electrically couples to the ground receptacle a the wall socket and extends from plug 182 to clipper case 112. When power cord 160 is plugged into a wall receptacle and motor power switch 156 is closed, 120 volt AC power is delivered to motor 116 to run blade assembly 114.

Plug 182 includes power converter 180, which in this embodiment converts 120 volt AC power into 5 volt DC power. Power converter 180 is electrically connected to 120 volt AC power conductor 162 and ground conductor 184. Power converter 180 receives 120 volt AC power from 120 volt AC conductor 162 and outputs 5 volts DC power on 5 volt DC power conductor 164 in response. Five volt DC power conductor 164 conducts 5 volt DC power from power converter 180 in plug 182 at plug end 166 of power cord 160, to clipper end 168 of power cord 160. Five volt DC power conductor 164 conducts 5 volt DC power into case 112 and to both first and second fan 118 and 120 through fan power switch 144. When power cord 160 is plugged into a wall receptacle and fan power switch 144 is closed, 5 volt DC power is delivered to fans 118 and 120. Clipper 110 uses power converter 180 because fans 118 and 120 run on 5 volt DC power. Fans 118 and 120 are designed to use 5 V DC power in order to lower power consumption and heat generation of hair clipper 110. Clipper 110 used power converter 180 in plug 182 so that power converter 180 does not add weight, take up room or generate heat inside clipper case 112. This allows clipper 110 to stay cool, while retaining a small form factor. If power converter 180 was located inside case 112, hair clipper 110 would weigh more consume more power, generate even more heat, and be unwieldy to handle while clipping hair.

FIG. 11 shows method 200 of forming a hair clipper. Method 200 includes step 210 of mounting a clipper motor inside a clipper case. Method 200 also includes step 220 of mounting a first fan inside the clipper case. Method 200 also includes step 230 of electrically coupling a power cord to the clipper motor and the first fan, where the power cord supplies 120 volt AC power to the motor, and 5 volt DC power to the first fan. Method 200 can include many other steps. In some embodiments method 200 includes mounting a second fan inside the clipper case, where the second fan receives 5 volt DC power from the power cord.

In some embodiments method 200 includes the step of forming a clipper case. In some embodiments the step of forming a clipper case includes forming a hollow cylindrical projection in the clipper case for enclosing a fan. In some embodiments method 200 includes the step of mounting a fan inside the clipper case such that it is enclosed by the hollow cylindrical projection.

The clipper case can be any size and shape to accommodate different types, sizes, and styles of hair clippers. FIG. 12 through FIG. 19 show additional embodiments of clipper top cases with shapes to accommodate different sizes and shapes of motors and blade assemblies. FIG. 12 through FIG. 15 show views of a clipper case top portion 228. Top portion 228 couples to a bottom portion to create a further embodiment of a clipper case. Top portion 228 includes hollow cylindrical projection 234 with cover 238 and plurality of vent holes 242. Cylindrical projection 234 makes space in top portion 228 for fan 218 (see FIG. 13 and FIG. 14). Fan 218 pulls air through plurality of vent holes 242 to cool motor 216 (see FIG. 14) as discussed earlier with top portion 128 and fan 118. Top portion 228 also includes thumb indent 258 with similar design and purpose as thumb indent 158 discussed earlier.

Figure 17:
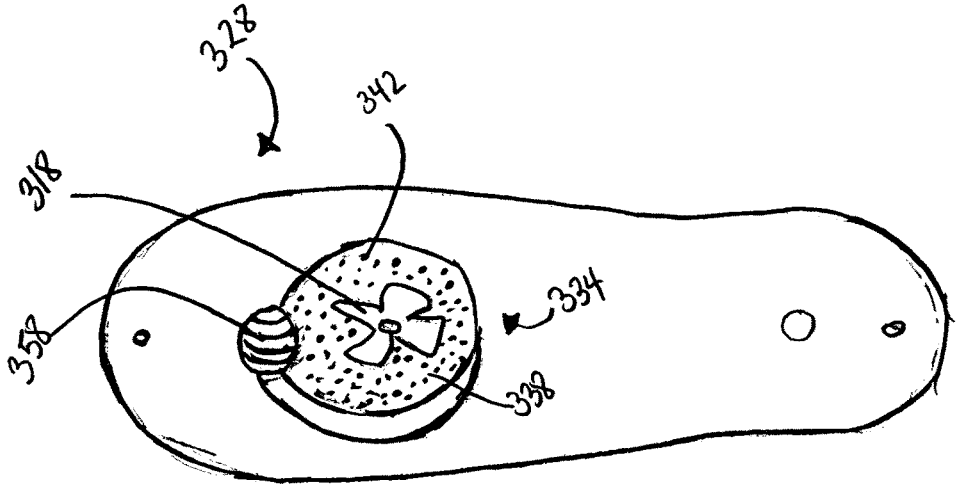
Figure 18:
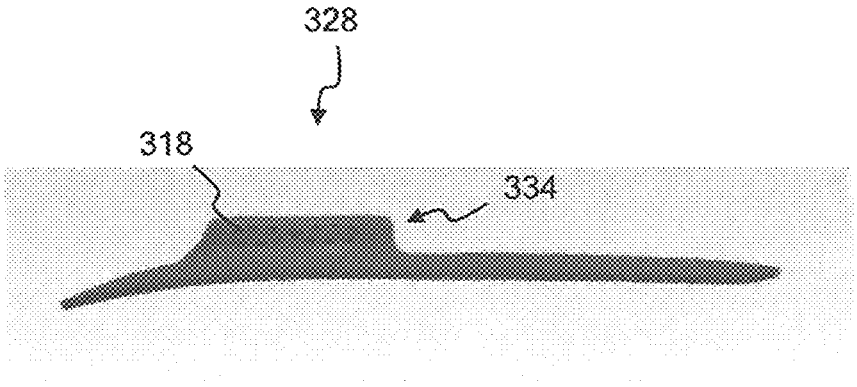
Figure 19:
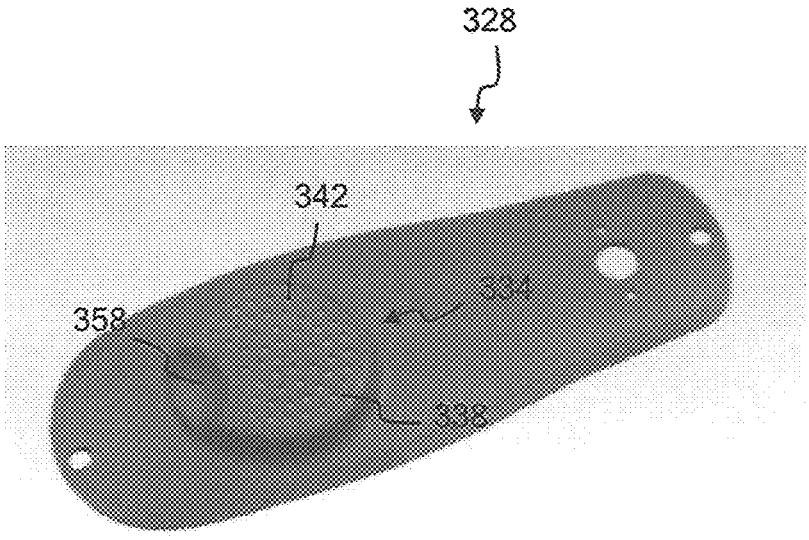

FIG. 16 through FIG. 19 show views of a clipper case top portion 328. Top portion 328 couples to a bottom portion to create a further embodiment of a clipper case. Top portion 328 includes hollow cylindrical projection 334 with cover 338 and plurality of vent holes 342. Cylindrical projection 334 makes space in top portion 328 for fan 318 (FIG. 17 and FIG. 18). Fan 318 pulls air through plurality of vent holes 342 to cool a clipper motor as discussed earlier with top portion 128 and fan 118. Top portion 328 also includes thumb indent 358 with similar design and purpose as thumb indent 158 discussed earlier.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above. Appendix A attached with this document includes additional drawings of embodiments of the disclosed hair clipper.

The invention claimed is:

1. A hand held apparatus for clipping hair, said apparatus comprising:

a hair clipper case, a blade assembly, a motor drivingly coupled to the blade, two cooling fans, first and secondary off/on switches:

whereas the first switch turns power off/on to the motor and the secondary switch turns power off/on to the cooling fans, a power cord that brings 120 v AC power from a wall receptacle to said motor and 5 volt DC power to said cooling fans:

wherein the power cord comprises four leads, two of the said leads go from the 120 volt wall receptacle to the first off/on switch to the motor, and the other two leads go from the 120 volt wall receptacle to a power inverter, to the secondary on/off on switch to the cooling fans.

2. The apparatus set forth in claim 1, wherein said cooling fans blow air over the motor to cool the motor so that the apparatus for clipping hair does not get hot to the touch.

3. The apparatus set forth in claim 1 further wherein the power inverter is in a plug end of the power cord.

4. The apparatus set forth in claim 3 wherein the apparatus receives a secondary 120 volt AC power source from the wall receptacle to the power inverter to be converted to 5 volt DC power, which after being converted sends 5 volt DC power source to the cooling fans.

5. The apparatus set forth in claim 1 wherein said switch is a power interrupter disposed in a 120 volt power line to the motor that turns power off/on to the motor and said second off/on switch is a power interrupter disposed in a 5 volt DC power line to the cooling fans source that goes from a power inverter to the cooling fans and turns power on/off to the cooling fans so that the cooling fans can run simultaneously or separately from the motor when the motor is off.

6. The apparatus set forth in claim 1 wherein the two separate off/on switches allow for selectively supplying power to the motor and or the cooling fans.

* * * * *